United States Patent [19]

Sugawara

[11] Patent Number: 4,926,093

[45] Date of Patent: May 15, 1990

[54] GYROTRON DEVICE

[75] Inventor: Toru Sugawara, Fujisawa, Japan

[73] Assignee: Kabushiki Kaisha Toshiba, Kawasaki, Japan

[21] Appl. No.: 172,802

[22] Filed: Mar. 28, 1988

[30] Foreign Application Priority Data

Mar. 31, 1987 [JP] Japan ..... 62-78519

[51] Int. Cl.[5] ..... H01J 25/00

[52] U.S. Cl. ..... 315/4; 315/5; 315/5.26

[58] Field of Search ..... 315/3, 4, 5, 5.13, 5.26, 315/5.52, 5.51; 372/2; 333/230; 330/4.8, 45

[56] References Cited

U.S. PATENT DOCUMENTS

| | | | |
|---|---|---|---|
| 2,952,820 | 9/1960 | Lewin | 333/114 |
| 3,815,136 | 6/1974 | Rootsey | 342/425 |
| 4,604,551 | 8/1986 | Moeller | 333/230 X |

FOREIGN PATENT DOCUMENTS 2543368 9/1984 France .

OTHER PUBLICATIONS

Edgcombe, "Gyrotrons for Megawatt Power Generation", Vacuum, vol. 30, No. 11/12, Nov.-Dec. 1980, pp. 473-477.

Gaponov et al, "Powerful Millimetre-Wave Gyrotrons", Int. J. Electronics, vol. 51, No. 4, 1981, pp. 277-302.

IEEE Transactions on Microwave Theory and Techniques, vol. MTT-28, No. 12, Dec. 1980, pp. 1477-1481, IEEE, New York, U.S.; L. R. Barnett et al: "Circular-Electric Mode Waveguide Couplers and Junctions for Use in Gyrotron Traveling-Wave Amplifiers".

IEEE Transations on Antennas and Propagation, vol. AP-21, No. 2 Mar. 1973, pp. 164-169, IEEE, New York, U.S.; G. F. Koch: "Coaxial Feeds for High Aperture Efficiency and Low Spillover of Paraboloidal Reflector Antennas".

*Primary Examiner*—Eugene R. LaRoche
*Assistant Examiner*—Seung Ham
*Attorney, Agent, or Firm*—Oblon, Spivak, McClelland, Maier & Neustadt

[57] ABSTRACT

A gyrotron device according to the present invention, having an electron gun for emitting an electron beam having an annular cross seciton, coils for applying a magnetic field to the electron beam emitted from the electron gun, a resonator for resonating the electron beam with microwaves and converting energy of the electron beam into microwaves, a collector for collecting the electron beam, a directional coupler for causing microwaves of a predetermined mode to pass, and a waveguide unit for guiding the microwaves from the directional coupler to an external portion.

8 Claims, 3 Drawing Sheets

GYROTRON DEVICE

BACKGROUND OF THE INVENTION (1) Field of the Invention

The present invention relates to a gyrotron device for generating microwaves and, more particularly, to a gyrotron device which comprises a coaxial resonator for converting energy of an electron beam into energy of an electromagnetic wave.

(2) Description of the Related Art

FIG. 1 shows a basic arrangement of a conventional gyrotron device for generating microwaves.

The gyrotron device comprises electron gun cathode 1 for emitting an electron beam, anode electrode 2 for controlling the electron beam emitted from cathode 1, magnet coils 3, 4 for applying a magnetic field to cause electrons of the electron beam to produce cyclotron motions, cavity resonator 5 for receiving the electrons of the electron beam and resonating them with microwaves so as to generate microwaves, collector 6 for collecting the electrons, dielectric output window 7 and output waveguide tube 8 for cooperatively outputting the generated microwaves.

In the above-described gyrotron device, electrons emitted from electron gun cathode 1 are controlled by anode electrode 2, and the cyclotron motions of the electrons are produced in the magnetic field of the magnet coils 3, 4. When the electrons pass through cavity resonator 5, their energy is converted into microwave energy by being resonated with the microwaves. The electrons which pass through cavity resonator 5 are collected by collector 6. The generated microwaves are passed through dielectric output window 7 and are output along output waveguide tube 8.

The gyrotron device, in general, generates microwaves by cyclotron resonance coupling between the electrons of which are displaying the cyclotron motions and the microwaves which are generated by cavity resonator 5. In the gyrotron device comprising cavity resonator 5, if a frequency of the microwaves is set high, a resonance frequency between the microwaves and the electrons in cavity resonator 5 is also high. When the resonance frequency is high, the inner diameter of cavity resonator 5 is limited so as to be small. For this reason, an inner wall area of cavity resonator 5 is minimized, so that the inner wall surface of cavity resonator 5 is heated to a high temperature by joule heat. Therefore, if high-output microwaves of a higher frequency are generated, the inner wall surface of cavity resonator 5 is heated to an extremely high temperature, which causes thermal deformation and destruction of the cavity resonator 5 which cannot withstand the heating. Therefore, it is difficult to realize the gyrotron device for oscillating the high-output microwaves of a high frequency.

SUMMARY OF THE INVENTION

It is an object of the present invention to provide a gyrotron device capable of minimizing heat generated by joule heat on an inner wall surface of a resonator and oscillating high-output microwaves having a high frequency.

According to the present invention, there is provided a gyrotron device comprising an electron gun means, having an axis, for emitting a beam of electrons having an annular cross section along the axis, means for applying an axial magnetic field to the electrons emitted from the electron gun means to cause the electrons to display cyclotron motions, resonating means having a cavity for receiving the electron beam and converting the energy of the electrons of the electron beam into microwave energy, the resonating means being provided with a substantially cylindrical outer conductor coaxially arranged along the axis on an outer surface of the resonating means, and a substantially columnar inner conductor coaxially arranged along the axis on the inner surface thereof, waveguide means having a coaxial waveguide along the axis for guiding the microwaves converted by the resonating means, and directional coupler means, having slots for performing electromagnetic-wave coupling between the cavity and the waveguide, for guiding the microwaves from the cavity to the waveguide.

According to the present invention, the temperature of the heating by joule heat on the inner wall surface of the resonating means can be minimized so as not to become too high. Therefore, unlike the conventional gyrotron device having a cavity resonator, the gyrotron device of the present invention can oscillate high-output microwaves having a high frequency.

In addition, the directional coupler means having the slots is arranged between the cavity and the waveguide, so that output microwaves having the required oscillation mode can be generated.

Other objects and effects of the present invention will be apparent from the description of an embodiment with reference to the accompanying drawings.

DETAILED DESCRIPTION OF THE PREFERRED EMBODIMENT

Figure 1:
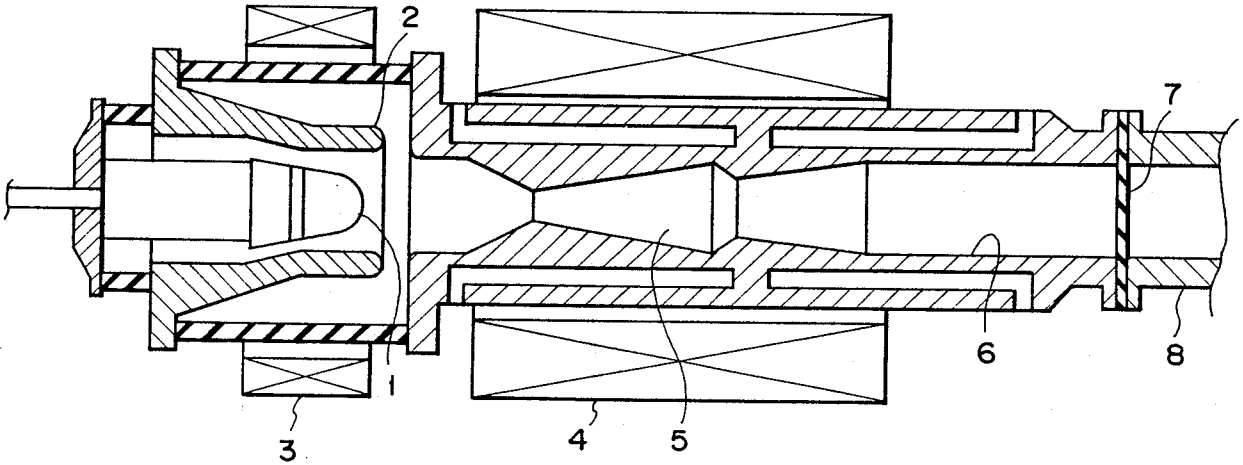
(PRIOR ART) FIG. 1
FIG. 1 is a sectional view showing a conventional gyrotron device.
Figure 2:
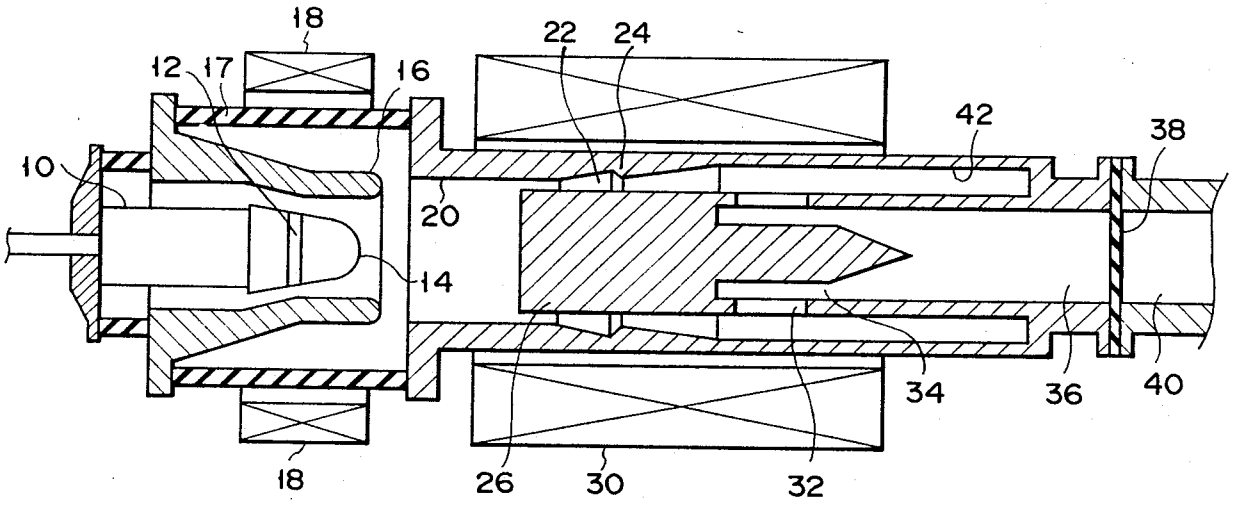
FIG. 2 is a sectional view showing a gyrotron device according to the present invention.

FIG. 2 shows a gyrotron device according to an embodiment of the present invention. The gyrotron device comprises substantially cylindrical metal housing 20 which has an axis. Housing 20 comprises substantially cylindrical outer conductor 24 which has an inner surface and substantially cylindrical inner conductor 26 which is coaxially located in outer conductor 24 and has an outer surface. A cavity, serving as a space for resonating the electrons with the microwave, is defined by the inner surface of outer conductor 24 and the outer surface of inner conductor 26. Main coils 30 are arranged on the outer surface of housing 20. In addition, substantially cylindrical electron gun housing portion 17 is bonded to one end of housing 20. Gun coils 18 are arranged on the outer surface of electron gun housing portion 17.

The gyrotron device includes magnetron type electron gun 10 which is housed in electron gun housing portion 17 and which emits an electron beam which has an annular cross section along the axial direction of the device. Gun coils 18 for generating a magnetic field along the axial direction are arranged on the outer surface of electron gun housing portion 17 in order to cause each electron of the electron beam emitted from electron gun 10 to display cyclotron motion. Substantially cylindrical outer conductor 24 and substantially cylindrical inner conductor 26 located on the inner side of outer conductor coaxially define cavity 22, which resonates the emitted electrons with microwaves, and are arranged in housing 20. In order to raise the rotational frequency of cyclotron motions of the electrons in cavity 22 to the predetermined frequency, main coils 30 for generating a magnetic field along the axial direction are arranged on the outer surface of outer conductor 24. Coaxial waveguide section 34 for outputting the microwaves from cavity 22 is formed between a cylindrical portion and a columnar portion having a conical distal end. The cylindrical and columnar portions are defined by portions of inner conductor 26 which extend along the axial direction. A plurality of slots 32 which guide the microwaves from cavity 22 to coaxial waveguide section 34 are formed in the cylindrical portion, which is the extended portion of inner conductor 26 located between cavity 22 and coaxial waveguide section 34. Collector 42 is arranged on the inner wall surface of the housing 20 to collect the electrons transmitted through cavity 22. In addition, first hollow waveguide tube 36 is arranged in housing 20 to guide the microwaves emitted from coaxial waveguide section 34. Circular dielectric output window 38 which guides the incident microwaves is in contact with first waveguide tube 36 in the housing 20. Furthermore, hollow second waveguide tube 40 is arranged in housing 20 to guide the microwaves from dielectric output window 38 to an external portion.

Electron gun 10 comprises hot cathode 14 and anode electrode 16. Hot cathode 14 includes annular electron emission zone 12. Substantially cylindrical anode electrode 16 is coaxial with hot cathode 14 so as to oppose the outer surface of hot cathode 14. The size of the plurality of slots 32 are defined to properly constitute a directional coupler.

Figure 3:
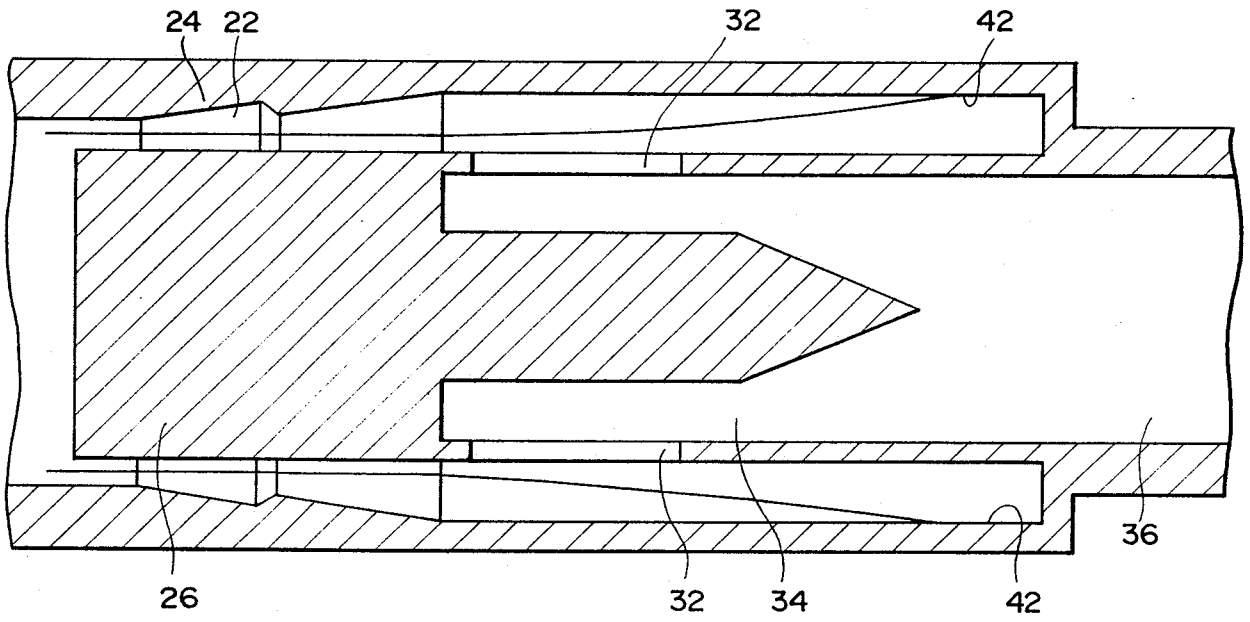
FIG. 3 is a sectional enlarged view showing a part of the gyrotron device shown in FIG. 2.

In FIGS. 2 and 3, the electron beam having an annular cross section is emitted from electron emission zone 12 in hot cathode 14 of electron gun 10. An electric field located between hot cathode 12 and anode electrode 16, and a magnetic field located along the axial direction, generated by gun coils 18 arranged on the outer surface of electron gun housing portion 17, cause the electrons of the electron beam to produce spiral motions. The electron beam is accelerated by the electric field between anode electrode 16, outer conductor 24, and inner conductor 26. The electron beam propagates along the axial direction while performing cyclotron motion. Then, the incident electron beam is cast upon cavity 22 in housing 20. The rotational frequency of the spiral movement of the electron beam is raised to the predetermined frequency by the magnetic field along the axial direction, generated by main coils 30. The electron beam is resonated with the microwaves in cavity 22 which have the predetermined frequency for converting the electrons into microwave energy of the predetermined frequency. The electrons of the electron beam, energy of which is converted into energy of microwaves, is guided by the magnetic field and is incident on collector 42. The electron beam is then converted into heat. The microwaves having the predetermined frequency, which are generated in cavity 22, pass through the plurality of slots 32 arranged in inner conductor 26 and are guided to coaxial waveguide section 34. Then, the microwaves having the predetermined frequency are output from coaxial waveguide section 34. The microwaves are incident on dielectric output window 38 through first waveguide tube 36. The microwaves are guided through second waveguide tube 40 and output outside from output window 38. The electron beam emitted from electron gun 10 has an annular cross section, so that the output microwaves are axially symmetrical.

In order to generate microwaves having the predetermined frequency, a distance between outer conductor 24 and inner conductor 26, i.e., the size of cavity 22 is determined to correspond with the predetermined frequency. According to the embodiment of the present invention, since the resonator for resonating the microwaves is coaxially arranged in the housing and along the axis of the housing, the inner diameter of the housing does not depend on the size of cavity 22 of the resonator. More specifically, since the inner diameter of the housing is not dependent upon the size of cavity 22, the inner diameter of the housing can be freely determined even if high-frequency microwaves are generated. Therefore, if high-output microwaves having a high frequency are generated, the inner area of housing 20 can be determined to be large, thereby preventing heating to a high temperature by joule heat.

In addition, slots 32 are formed in the directional coupler, thus minimizing generation of an unnecessary mode of the microwaves. The distal end of the extended cylindrical portion of inner conductor 26 is conical, so that a mismatching mode of the microwaves can be prevented. Therefore, the necessary microwaves are effectively generated.

According to the above embodiment of the present invention, the distal end of the extended cylindrical portion of inner conductor 26 is conical in order to prevent the mismatching modes. However, other shapes may be used. Various changes and modifications may be made within the spirit and scope of the present invention.

What is claimed is:

1. A gyrotron device comprising:

electron gun means, having an axis, for emitting a beam of electrons which have an annular cross section along the axis;

means for applying an axial magnetic field to said electrons emitted from said electron gun means to produce cyclotron motion;

resonating means having a cavity for receiving said electron beam and converting energy of every electron within said electron beam into energy in the form of microwaves, said resonating means being provided with a substantially cylindrical outer conductor coaxially arranged along said axis on an outer surface of said resonating means, and a substantially columnar inner conductor coaxially arranged along said axis on an inner surface thereof, and extended portions of said substantially columnar inner conductor having a conical distal end which is coaxially with said columnar portion;

waveguide means having a coaxial waveguide along said axis for guiding said microwaves converted by said resonating means; and directional coupler means, having slots for performing an electromagnetic-wave coupling between said cavity and said waveguide, for guiding said microwaves from said cavity to said waveguide.

2. The device according to claim 1, wherein said electron gun means is of a magnetron type.

3. The device according to claim 1, wherein said magnetic field applying means comprises at least one coil arranged on an outer surface of said electron gun means to cause said electrons to produce cyclotron motions, and at least one coil arranged on the outer surface of said resonating means to cause said electrons to display said cyclotron motions in accordance with a predetermined frequency.

4. The device according to claim 1, wherein said resonating means comprises a resonator on an inner surface of said substantially cylindrical outer conductor.

5. The device according to claim 1, wherein said resonating means comprises a collector for collecting the electrons.

6. The device according to claim 1, wherein said waveguide means is defined between the cylindrical and columnar portions which extend from said substantially columnar inner conductor.

7. The device according to claim 1, wherein said waveguide means comprises an output window.

8. The device according to claim 1, wherein said slots of said directional coupler means are formed in said cylindrical portions which extends from said substantially columnar inner conductor.

* * * * *